US007904998B2

(12) United States Patent
Motz et al.

(10) Patent No.: US 7,904,998 B2
(45) Date of Patent: Mar. 15, 2011

(54) CASKET AND MEMORIALIZATION ACCESSORY

(75) Inventors: Jancy A. Motz, Fishers, IN (US); Ilija Rojdev, Cincinnati, OH (US)

(73) Assignee: Batesville Services, Inc., Batesville, OH (US)

( * ) Notice: Subject to any disclaimer, the term of this patent is extended or adjusted under 35 U.S.C. 154(b) by 247 days.

(21) Appl. No.: 12/240,647

(22) Filed: Sep. 29, 2008

(65) Prior Publication Data

US 2010/0077578 A1 Apr. 1, 2010

(51) Int. Cl.
*A61G 17/00* (2006.01)

(52) U.S. Cl. ..... 27/10; 27/1; 27/2; 47/66.6; 206/423

(58) Field of Classification Search ..... 27/10, 2, 27/1, 19, 30; 47/41.01, 66.6; 206/423; 248/27.8; D99/8, 13; 40/124.5; 428/542.4, 913.3
See application file for complete search history.

(56) References Cited

U.S. PATENT DOCUMENTS 1,652,936 A * 12/1927 Heinz et al. ..... 248/27.8
2,296,529 A * 9/1942 Lombardi ..... 248/27.8
4,324,026 A 4/1982 Craft
4,387,534 A * 6/1983 Lewandowski et al. ..... 47/66.6
4,457,054 A 7/1984 Craft et al.
5,611,124 A 3/1997 Biondo et al.
5,675,876 A 10/1997 Benedict et al.
5,678,289 A 10/1997 Saaf
5,727,291 A 3/1998 Biondo et al.
5,815,897 A * 10/1998 Longstreth ..... 27/1
5,903,961 A * 5/1999 Parker et al. ..... 27/1
D418,961 S 1/2000 Biondo et al.
6,145,245 A * 11/2000 Honkawa et al. ..... 47/41.01
6,557,222 B2 5/2003 Groemminger et al.
6,591,466 B1 7/2003 Acton et al.
6,691,385 B2 2/2004 Bell et al.
6,715,190 B2 4/2004 Groemminger et al.
6,735,831 B1 5/2004 Greiwe et al.
6,836,936 B1 1/2005 Biondo et al.
6,883,212 B2 4/2005 Groemminger et al.
6,898,830 B1 5/2005 Acton et al.
6,928,706 B2 8/2005 Acton et al.
6,976,294 B2 12/2005 Biondo et al.
7,210,204 B2 5/2007 Groemminger et al.
7,316,054 B2 1/2008 Acton et al.
7,320,162 B2 * 1/2008 Parker et al. ..... 27/19
(Continued)

OTHER PUBLICATIONS 2 drawing sheets of a casket corner ornament attachment clip in public use or on sale in the United States greater than one year prior to Sep. 29, 2008.

(Continued)

*Primary Examiner* — William L. Miller
(74) *Attorney, Agent, or Firm* — Wood, Herron & Evans, LLP

(57) ABSTRACT

A casket and memorialization accessory combination comprises a casket comprising a casket shell having a pair of side walls and a pair of end walls and a casket lid closable on the casket shell, a decorative ornament, and a planter adapted to receive a plant therein. The casket shell and ornament are configured such that the ornament is removably attachable to the casket shell. The planter and ornament are configured such that the ornament is attachable to the planter. The ornament can be removed from the casket in which a deceased was displayed for viewing and attached to the planter so that the planter and ornament can be presented to a loved one of the deceased as a memorial to the deceased.

46 Claims, 6 Drawing Sheets

U.S. PATENT DOCUMENTS

| | | | | |
|---|---|---|---|---|
| 7,340,810 | B2 | 3/2008 | Acton et al. | |
| 7,392,574 | B2 | 7/2008 | Bovard et al. | |
| 7,698,792 | B1 * | 4/2010 | Parker | 27/10 |
| 2005/0039398 | A1 * | 2/2005 | Corona | 47/66.6 |
| 2009/0025289 | A1 * | 1/2009 | Krieg | 47/66.6 |
| 2009/0293355 | A1 * | 12/2009 | Clouston | 47/67 |
| 2010/0077577 | A1 | 4/2010 | Rojdev | |
| 2010/0077579 | A1 | 4/2010 | Parker | |
| 2010/0077580 | A1 | 4/2010 | Holzman | |

OTHER PUBLICATIONS

Notice of Allowance, U.S. Appl. No. 12/240,598, 12 pages, Aug. 2, 2010.

* cited by examiner

CASKET AND MEMORIALIZATION ACCESSORY

RELATED APPLICATIONS

None.

FIELD

This relates generally to caskets, and more particularly to memorialization accessories for use separately and/or with caskets.

BACKGROUND

There is a trend in the death care industry towards personalizing to the deceased the funeral products and the funeral or other memorial service to provide a more meaningful memorial experience for the family and friends of the deceased. The casket in which the deceased is displayed can be customized to fit the needs and preferences of the deceased and the family. For instance, a wide variety of materials, finishes, colors, and decorative ornamentation can be chosen for the casket.

Some casket designs incorporate decorative corner ornaments secured to the casket during fabrication thereof. In many, if not most, prior designs, these ornamental corner pieces are rigidly affixed to the casket shell. Consequently, if a customer purchasing the casket is not pleased with the particular pre-installed ornamental corner pieces, and wishes to customize the casket exterior to his or her taste, the funeral director must go through a lengthy and complicated process to first remove the original ornamental corner pieces and then reinstall the ornamental corner pieces chosen by the customer. This process typically requires manual manipulation and access to the interior of the casket which may require the removal of bedding, lining, and the like. Such a process is time consuming and can damage the otherwise new casket and is thus frowned upon and generally avoided by the funeral director.

To more effectively market caskets, the funeral director desires to offer a wide variety of ornamental corner pieces from which a customer can select according to the customer's taste. However, to offer such a wide selection, and to avoid the undesirable practice mentioned above, the funeral director would have to maintain a large inventory of many different casket material/finish and corner piece combinations, which is also undesirable. To minimize the required inventory of finished caskets, the funeral director could simply have one casket of each material/finish on hand provided that the funeral director had some means providing for the quick and efficient changing of the ornamental corner pieces on each casket. As such, the customer could quickly view numerous corner pieces on a single casket, and the funeral director would need only stock a single casket of each material finish. Many prior casket designs, which rigidly affix the ornamental corner pieces, do not permit such quick and efficient changing of the ornamental corner pieces as discussed above.

A quick-change casket corner mechanism is disclosed in Acton et al. U.S. Pat. Nos. 6,591,466, 5,928,706, and 7,340,810, assigned to the assignee of the present invention and incorporated by reference herein. The Acton et al. patents disclose an ornamental corner piece assembly having a back plate that attaches to the corner of a casket. The back plate includes a clip member having at least one keyhole groove. A decorative corner insert includes at least one attachment member that slidingly engages the keyhole groove in the clip member such that the corner insert removably couples to the back plate. In this way, a funeral director may quickly and conveniently change out the decorative corner pieces to provide a wide variety of casket designs personalized to the deceased. Such a quick change casket corner ornament is commercially available from the assignee as its LIFESYMBOLS® line of corner ornaments.

A further advance in the areas of personalization and memorialization is the subject of Groemminger et al. U.S. Pat. Nos. 6,557,222, 6,883,212, and 7,210,204, assigned to the assignee of the present invention and incorporated by reference herein. The Groemminger et al. patents disclose a casket ornament display plaque and associated methods for memorializing a deceased. The casket ornament display plaque comprises a decorative board, a casket ornament attached to the board, and indicia attached to the board identifying the deceased to be memorialized. The casket ornament is one having been removed from a casket in which the deceased was displayed or one that is substantially identical thereto.

Advances have therefore been made in the area of casket designs incorporating decorative or ornamental corner pieces as demonstrated with the product discussed above. However, there continues to be room for improvement in the area of personalization in the death care industry.

SUMMARY

A casket and memorialization accessory combination comprises a casket comprising a casket shell having a pair of side walls and a pair of end walls and a casket lid closable on the casket shell, a decorative ornament, and a planter adapted to receive a plant therein. The casket shell and ornament are configured such that the ornament is removably attachable to the casket shell. The planter and ornament are configured such that the ornament is attachable to the planter. The ornament can be removed from the casket in which a deceased was displayed for viewing and attached to the planter so that the planter and ornament can be presented to a loved one of the deceased as a memorial to the deceased.

The combination can further comprise apparatus for removably securing the ornament to the shell and to the planter, comprising a first attachment element associated with the shell, a second attachment element associated with the ornament, and a third attachment element associated with the planter. The first and second attachment elements are configured for removably securing the ornament to the shell, and the second and third attachment elements are configured for securing the ornament to the planter. One of the first and second attachment elements can be at least one groove and the other of the first and second attachment elements can be at least one fastener having a head thereon. The third attachment element can be the same type of attachment element as the first attachment element. The groove can comprise a slot and an opening communicating with the slot, the opening being of a greater dimension than the slot. The fastener can be a threaded fastener, for example a screw, for example a shoulder screw. The shell can have a mounting member disposed between adjacent ones of the side and end walls, and the ornament can be mounted to the mounting member. The mounting member can be oriented at about a 45° angle relative to the adjacent ones of the side and end walls. The first, second, and third attachment elements can be configured such that the ornament is removably secured to the shell and to the planter via motion in first and second non-parallel directions generally parallel to a plane defined by a mounting surface of the shell and the planter. The motion in the first and second directions can be rectilinear. The groove can include a first keyhole portion and a second non-keyhole portion. The first keyhole portion can have a first longitudinal axis, the second non-keyhole portion can have a second longitudinal axis, and the first and second longitudinal axes can be non-parallel. The first and second longitudinal axes can be perpendicular. The ornament can be a corner ornament. The planter can have an alcove structure on a side wall thereof for receiving the ornament.

In another aspect, a memorialization accessory for memorializing a deceased comprises a planter adapted to receive a plant therein and having a first fastener element, an ornament including a second fastener element, the ornament attached to the planter with the first and second fastener elements, the ornament being previously attached to a casket in which the deceased was displayed for viewing, or being substantially identical to an ornament attached to the casket in which the deceased was displayed for viewing.

In another aspect, a method of memorializing a deceased comprises displaying the deceased for viewing in a casket to which is mounted an ornament, removing the ornament from the casket, mounting the ornament on a planter, and presenting the planter and ornament to a loved one of the deceased as a memorial to the deceased.

The method can further comprise placing a plant in the planter prior to presenting the planter to the loved one.

In another aspect, a method of memorializing a deceased comprises displaying the deceased for viewing in a casket to which is mounted an ornament, providing a planter, mounting an ornament, which is substantially identical to the ornament mounted on the casket, to the planter, and presenting the planter and ornament to a loved one of the deceased as a memorial to the deceased.

The planter can be a combination planter and cremation urn.

The combination can further comprise an attachment clip for removably attaching the ornament to the shell and/or for removably attaching the ornament to the planter. The attachment clip can comprise a front portion having a pair of vertically spaced right angle keyhole grooves therethrough, having a rearwardly projecting circular post, and having a rectangular rib adjacent said post, and a back portion having a pair of vertically spaced spring tabs each of which cooperates with one of the pair of vertically spaced right angle keyhole grooves, having a circular hole for receiving the circular post, and having a rectangular hole for receiving the rectangular rib. The ornament can include a pair of vertically spaced fasteners on a rear side thereof, each of which includes a head thereon. Each spring tab can include a pair of ribs spaced apart to accept the head of a respective one of the pair of fasteners.

DRAWINGS

DESCRIPTION

Figure 1:
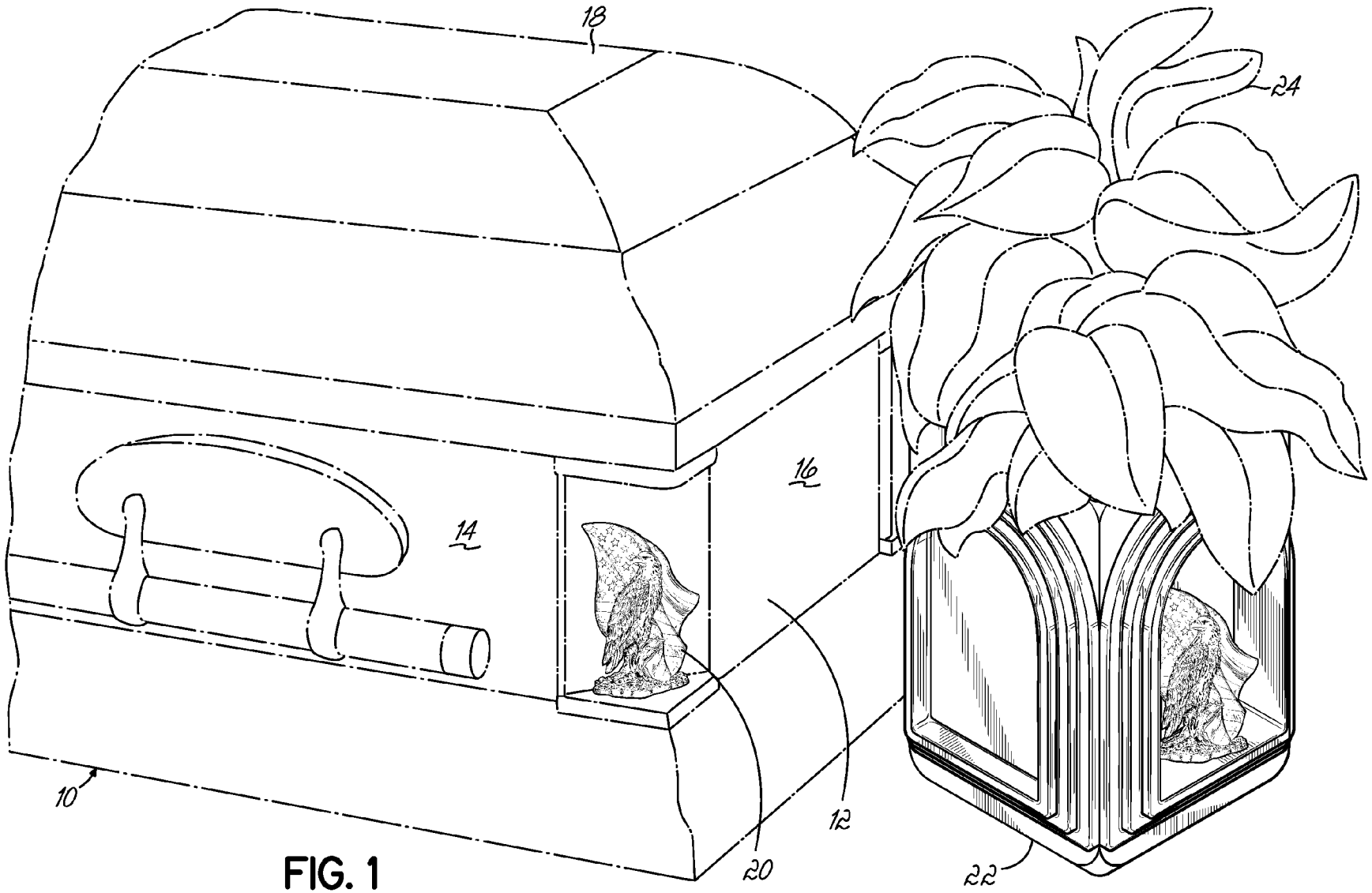
FIG. 1 is a partial perspective view of a casket and memorialization accessory.
Figure 2:
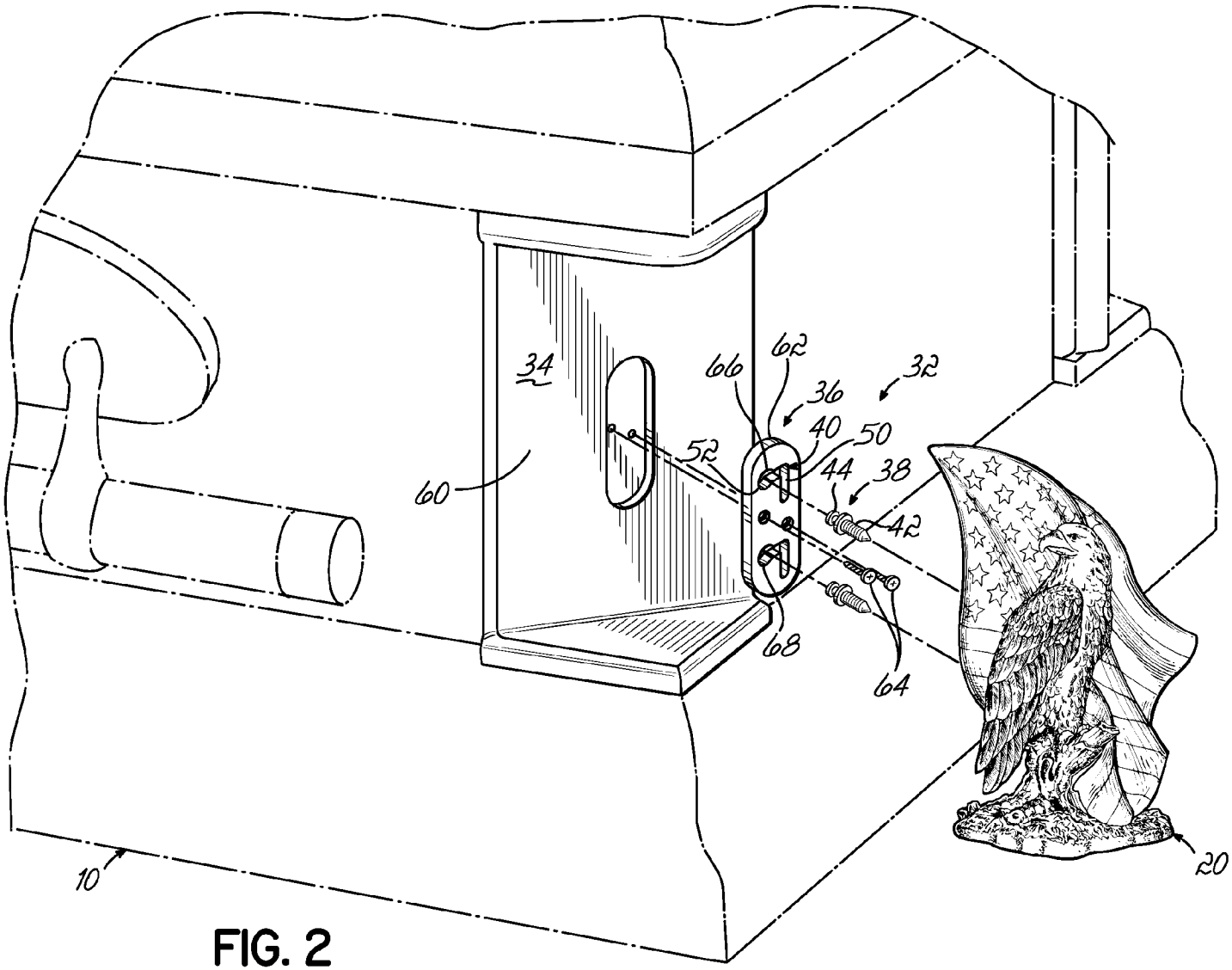
FIG. 2 is an exploded partial perspective view of the casket and ornament of FIG. 1.
Figure 3:
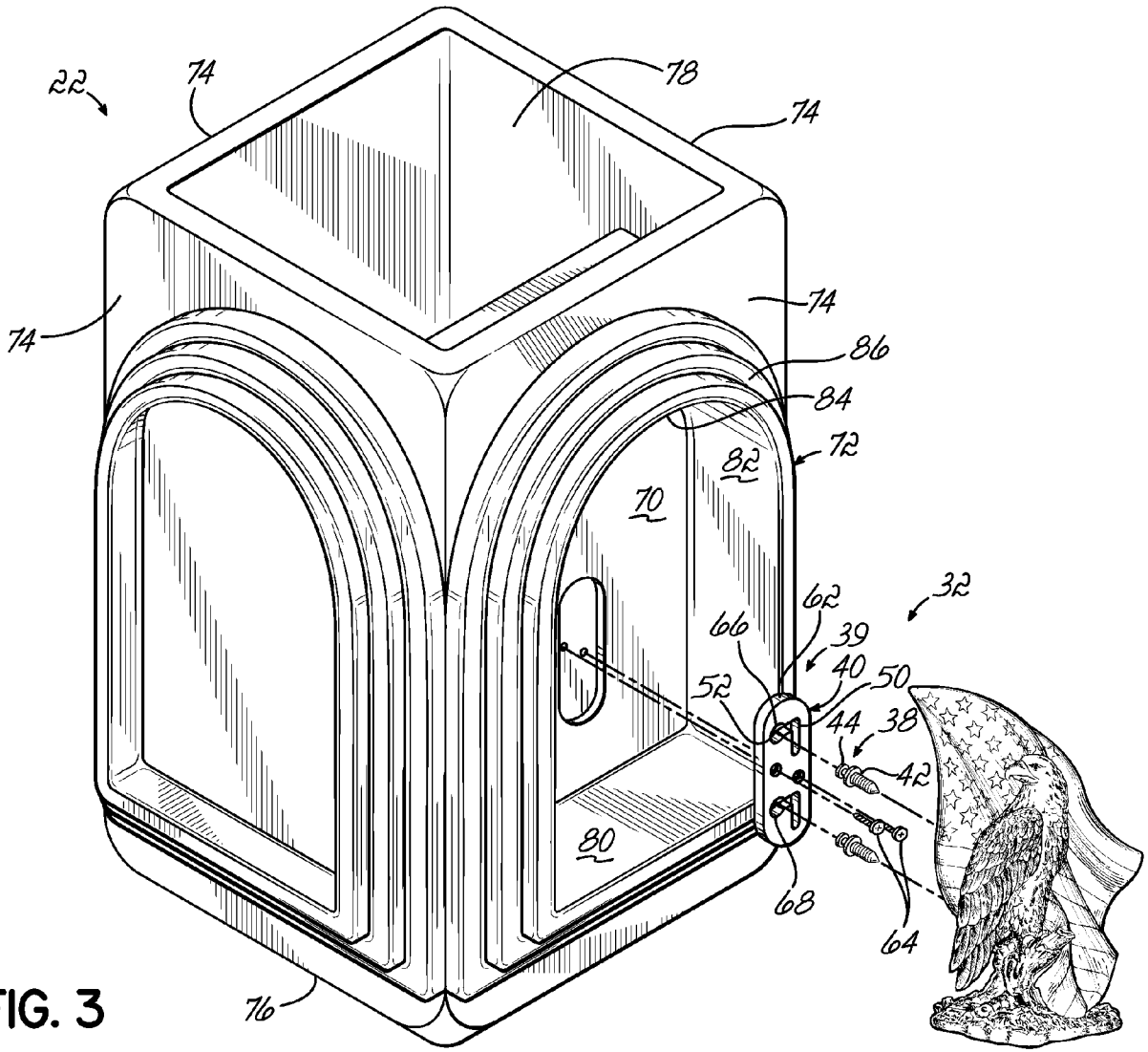
FIG. 3 is an exploded perspective view of the memorialization accessory and ornament of FIG. 1.

Referring to the figures, a casket 10 comprises a casket shell 12 having a pair of side walls 14 and a pair of end walls 16, a casket lid 18 closable on the casket shell 12, and an ornament 20, for example a corner ornament, mounted to the shell 12. Memorialization accessory 22 takes the form of a planter which is adapted to receive a plant 24 therein. The casket shell 12 and ornament 20 are configured such that the ornament 20 is removably attachable to the casket shell 12. The planter 22 and ornament 20 are configured such that the ornament 20 is attachable to the planter 22. The ornament 20 can be removed from the casket 10 in which a deceased was displayed for viewing and attached to the planter 22. In this way that the planter 22 and ornament 20 can be presented to a loved one of the deceased as a memorial to the deceased.

The casket 10, ornament 20, and memorialization accessory 22 can further comprise apparatus 32 for removably securing the ornament 20 to a mounting surface 34 of the shell 12 and for securing the ornament 20 to the planter 22. That apparatus 32 can comprise a first attachment element 36 associated with the mounting surface 34 of the shell 12, a second attachment element 38 associated with the ornament 20, and a third attachment element 39 associated with the planter 22. The first 36 and second 38 attachment elements are for removably securing the ornament 20 to the shell 12, and the second 38 and third 39 attachment elements are configured for securing the ornament 20 to the planter 22. One of the first 36 and second 38 attachment elements can be at least one groove 40 and the other of the first 36 and second 38 attachment elements can be at least one fastener 42 having a head 44 thereon. The third attachment element 39 can be of the same type of attachment element as the first attachment element 36. The groove 40 can comprise a slot 50 and an opening 52 communicating with the slot 50, the opening 52 being of a greater dimension than the slot 50. The fastener 42 can be a threaded fastener, for example a screw. The screw can be for example a shoulder screw.

Figure 4:
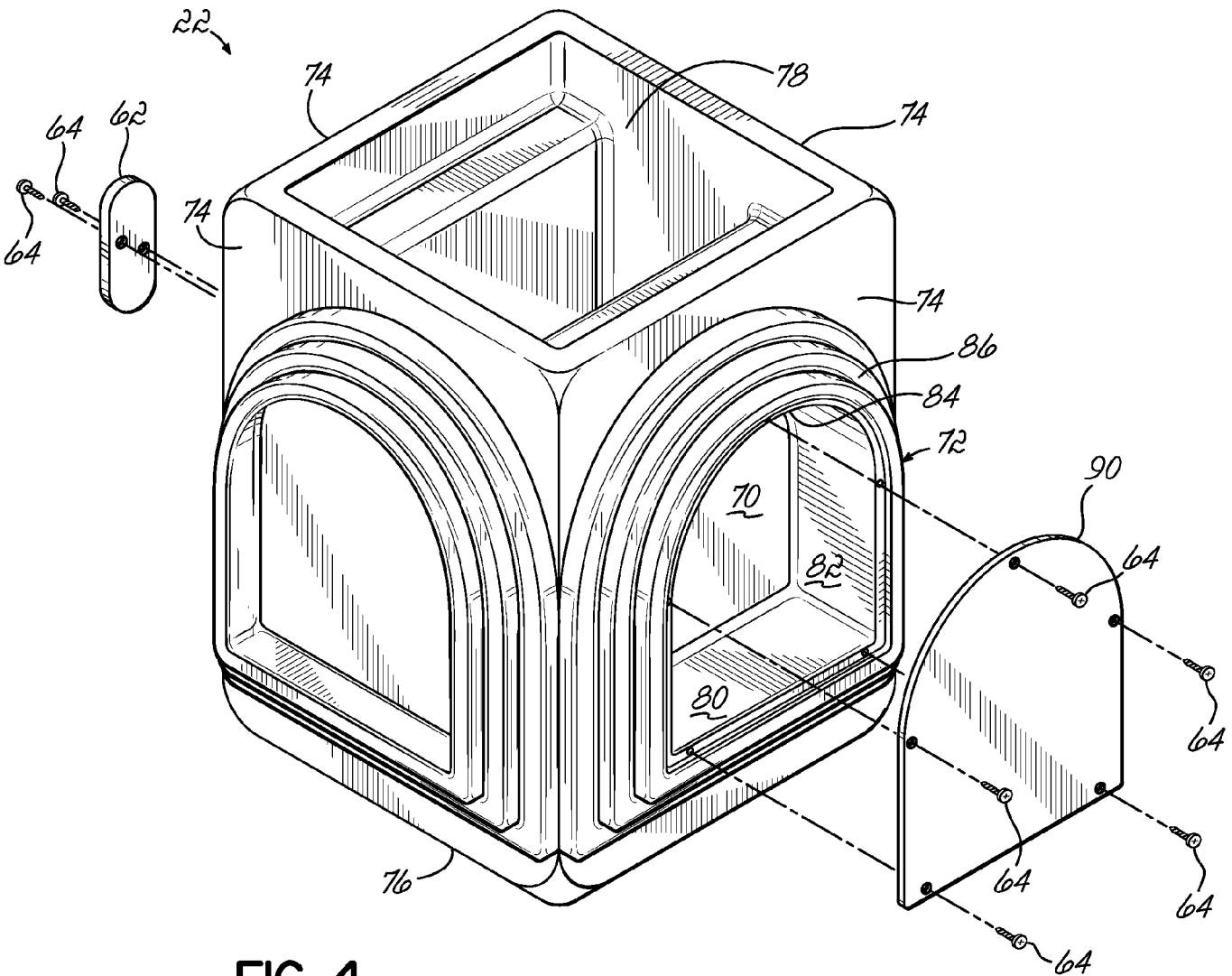
FIG. 4 is a view similar to FIG. 3 wherein the memorialization accessory is a combination planter and cremation urn.
Figure 5:
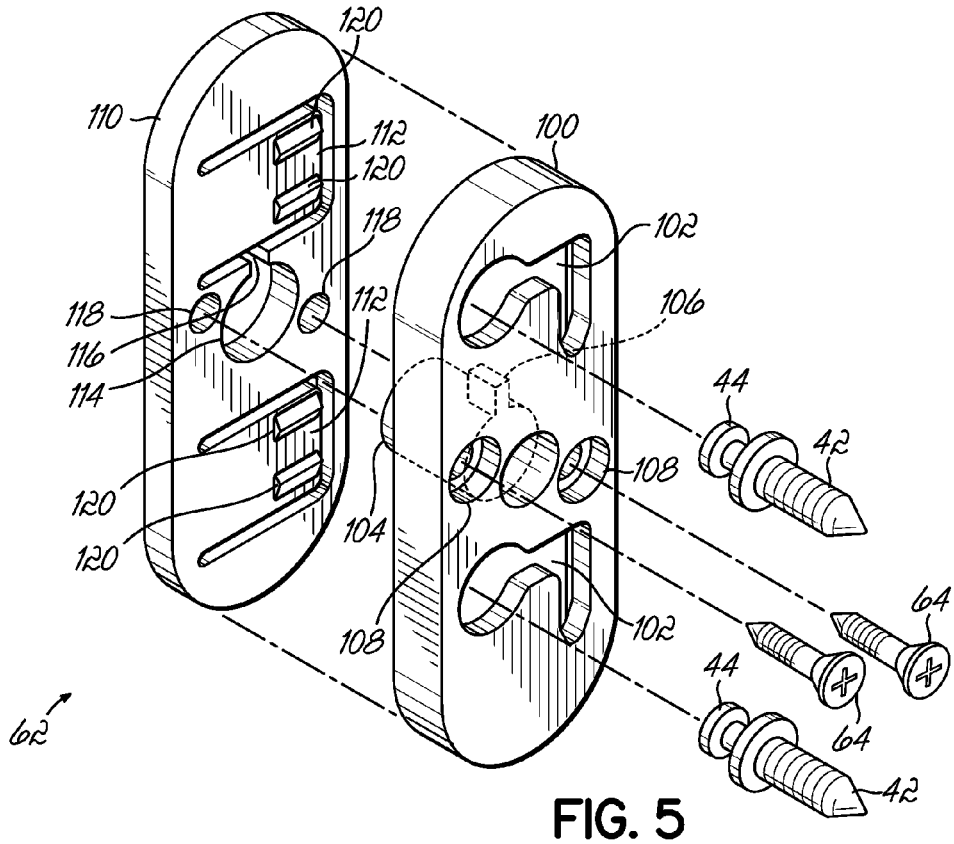
FIG. 5 is an exploded perspective view of an attachment clip for attaching the ornament to the casket.
Figure 6:
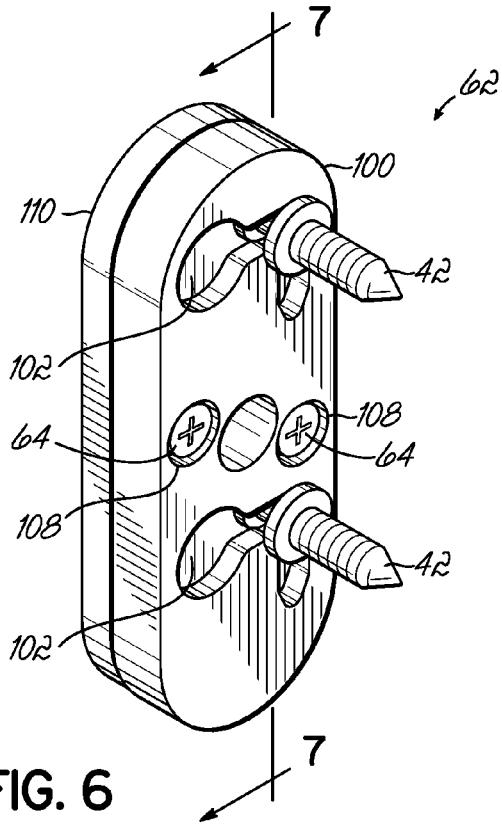
FIG. 6 is an assembled perspective view of the attachment clip of FIG. 5.

The shell 12 can have a mounting member 60 disposed between adjacent ones of the side 14 and end 16 walls, and the ornament 20 can be mounted to the mounting member 60. Accordingly in this example the mounting surface 34 is a part of the mounting member 60 of the shell 12. Mounting member 60 can be the back plate shown and described in the Acton et al patents. Other mounting surfaces and members are possible. The mounting member 60 can be oriented at about a 45° angle relative to the adjacent ones of the side 14 and end 16 walls. The first attachment element 36 can be associated with the mounting member 60, and the second attachment element 38 can be associated with the ornament 20. For example, groove 40, or a pair of grooves 40, can be formed in an attachment clip 62 secured to mounting member 60 with screws 64, and the shoulder screws 42 can be secured to the rear side of the ornament 20. The third attachment element 39 can also be a groove 40 or pair of grooves 40 formed in an attachment clip 62 secured to a mounting surface or member of planter 22, which as illustrated, is a rear wall 70 of an alcove structure 72 formed in one of the walls 74 of the planter 22. An exemplary planter 22 is the one illustrated which has four walls 74, a bottom 76, and an open top 78. Other configurations of planter are of course possible and are within the scope of the claims. The illustrated alcove structure 72, as mentioned, has a rear wall 70 and can have a floor 80, side walls 82, and a top wall 84, and decorative molding 86 around a perimeter of the opening of the alcove 72. Other configurations of alcove structures and planter mounting surfaces are of course possible and are within the scope of the claims. For additional details of a similar alcove structure usable in cap panels of caskets, see the assignee's U.S. Pat. No. 7,322,080, hereby incorporated by reference herein. A second alcove structure 72 can be included as shown in FIG. 4 with a removable cover 90 for receiving cremation remains.

The first 36 and second 38 attachment elements can be configured such that the ornament 20 is removably secured to the shell 12 via motion in first and second non-parallel directions generally parallel to a plane defined by the mounting member 60. The groove(s) 30 can include a first keyhole portion 66 and a second non-keyhole portion 68. The first keyhole portion 66 can have a first longitudinal axis, the second non-keyhole portion 68 can have a second longitudinal axis, and the first and second longitudinal axes can be non-parallel. For example, the first and second longitudinal axes can be perpendicular. For examples, the first and second directions can be rectilinear or curvilinear.

To install the ornament 20, the head(s) 44 of the fastener(s) 42 are inserted into opening(s) 52 of groove(s) 40; ornament 20 is then moved generally parallel to a plane defined by mounting member 60 or 70 from left to right as illustrated thus sliding head(s) 44 from left to right in slot(s) 40. The ornament 20 is then moved again generally parallel to the plane defined by the mounting member 60 or 70 downwardly thus sliding head(s) 44 down in slot(s) 50. While not required, the multi-direction movement to install ornament 20 can reduce the potential for the ornament 20 to become inadvertently dislodged.

In use, a deceased is displayed for viewing in the casket 10 to which is mounted an ornament 20. After the viewing or funeral or other memorial service, the ornament 20 is removed from the casket 10 and mounted on the planter 22. The planter 22 with ornament 20 mounted thereon can then be presented to a loved one of the deceased as a memorial to the deceased. If desired a plant can be placed in the planter 22 prior to presenting it to the loved one. Alternatively, an ornament which is substantially identical to the ornament that was mounted on the casket can be mounted on the planter, if for some reason the actual ornament cannot be removed from the casket.

Figure 7A:
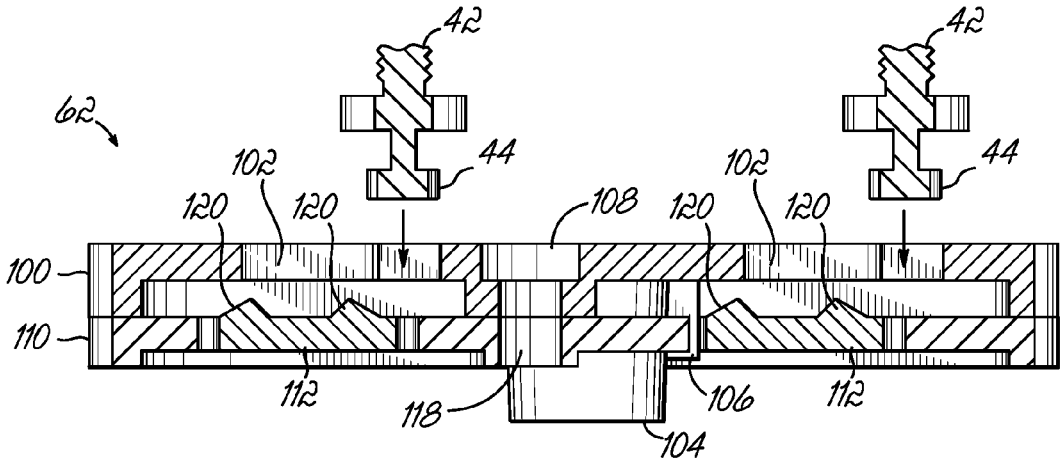
FIG. 7A is a view taken along line 7-7 in FIG. 6 showing the ornament and its fastener prior to attachment to the attachment clip.
Figure 7B:
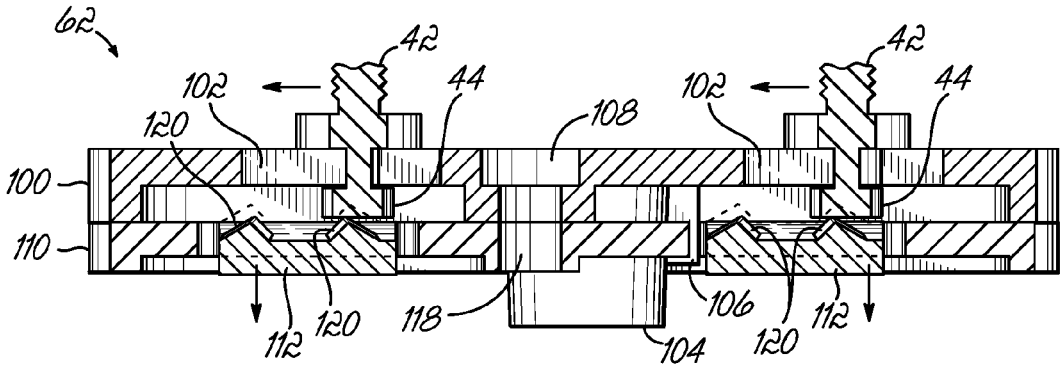
FIG. 7B is a view similar to FIG. 7A showing the ornament fastener head inserted into the attachment clip.
Figure 7C:
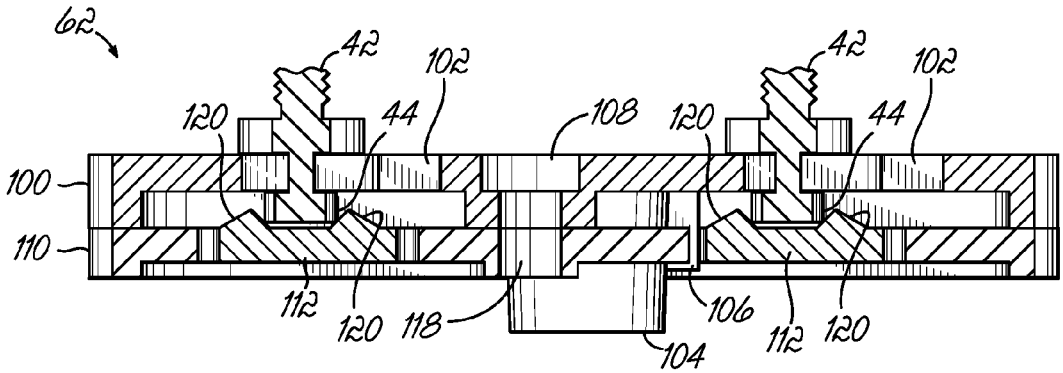
FIG. 7C is a view similar to FIG. 7B showing the ornament fastener head slid into its final position in the attachment clip and coming to rest between the two ribs on the spring tab.

Referring to FIGS. 5-7C, one form of attachment clip 62 which could be used is illustrated. The attachment clip 62 can have a front portion 100 having a pair of vertically spaced right angle keyhole grooves 102 therethrough, a rearwardly projecting circular post 104, and a rectangular rib 106 adjacent the post 104. The attachment clip 62 can have a back portion 110 having a pair of vertically spaced spring tabs 112 each of which cooperates with one of the pair of vertically spaced right angle keyhole grooves 102, a circular hole 114 for receiving the circular post 104, and a rectangular hole 116 for receiving the rectangular rib 106. Post 104, rib 106, hole 114, and hole 116 are to properly orient the front portion 100 with the back portion 110. Both portions have holes 108, 118, respectively, for receiving screws 54, rivets, etc. Each spring tab 112 can include a pair of ribs 120 which are spaced apart to accept the head 34 of fastener 32. As seen in FIGS. 7A-7C, heads 34 are inserted into keyhole grooves 102, slid to the right, and then slid down. Sliding the heads 34 down causes the spring tabs 112 to deflect rearwardly as heads 34 travel down and over the uppermost ones of the pairs of ribs 112. Once over the uppermost ones of the pairs of ribs 112, spring tabs spring forwardly retaining heads 34 between ribs 112 and against a rear surface of keyhole grooves 102.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A casket and memorialization accessory combination comprising:

a casket comprising a casket shell having a pair of side walls and a pair of end walls and a casket lid closable on said casket shell, a decorative ornament, a planter adapted to receive a plant therein, said casket shell and ornament being configured such that said ornament is removably attachable to said casket shell, said planter and ornament being configured such that said ornament is attachable to said planter, and apparatus for removably securing said ornament to said shell and to said planter, said apparatus comprising:

a first attachment element associated with said shell, a second attachment element associated with said ornament, and a third attachment element associated with said planter, said first and second attachment elements cooperating to removably secure said ornament to said shell, said second and third attachment elements cooperating to removably secure said ornament to said planter, wherein said third attachment element is the same as said first attachment element, whereby said ornament can be removed from said casket in which a deceased was displayed for viewing and attached to said planter so that said planter and ornament can be presented to a loved one of the deceased as a memorial to the deceased.

2. The combination of claim 1 wherein one of said first and second attachment elements is at least one groove, and the other of said first and second attachment elements is at least one fastener having a head thereon.

3. The combination of claim 2 wherein said at least one groove comprises a slot and an opening communicating with said slot, said opening being of a greater dimension than said slot.

4. The combination of claim 3 wherein said fastener is a threaded fastener.

5. The combination of claim 4 wherein said threaded fastener is a screw.

6. The combination of claim 5 wherein said screw is a shoulder screw.

7. The combination of claim 1 wherein said first, second, and third attachment elements are configured such that said ornament is removably secured to said shell and to said planter via motion in first and second non-parallel directions generally parallel to a plane defined by a mounting surface of said shell and said planter.

8. The combination of claim 7 wherein one of said first and second attachment elements is at least one groove, and the other of said first and second attachment elements is at least one fastener having a head thereon.

9. The combination of claim 8 wherein said at least one groove includes a first keyhole portion and a second non-keyhole portion.

10. The combination of claim 9 wherein said first keyhole portion has a first longitudinal axis, said second non-keyhole portion has a second longitudinal axis, and said first and second longitudinal axes are non-parallel.

11. The combination of claim 10 wherein said first and second longitudinal axes are perpendicular.

12. The combination of claim 7 wherein said motion in said first and second directions is rectilinear.

13. The combination of claim 1 wherein said shell has a mounting member disposed between adjacent ones of said side and end walls, and said ornament is mounted to said mounting member.

14. The combination of claim 13 wherein said mounting member is oriented at about a 45° angle relative to said adjacent ones of said side and end walls.

15. The combination of claim 1 wherein said ornament is a corner ornament.

16. The combination of claim 1 wherein said planter has an alcove structure on a side wall thereof for receiving said ornament.

17. The combination of claim 16 wherein said planter has a second alcove structure on a second side wall thereof for receiving cremation remains and a cover removably secured on said second alcove structure.

18. The combination of claim 1 further comprising an attachment clip for removably attaching said ornament to said shell, said attachment clip comprising:

a front portion having a pair of vertically spaced right angle keyhole grooves therethrough, having a rearwardly projecting circular post, and having a rectangular rib adjacent said post, and a back portion having a pair of vertically spaced spring tabs each of which cooperates with one of said pair of vertically spaced right angle keyhole grooves, having a circular hole for receiving said circular post, and having a rectangular hole for receiving said rectangular rib.

19. The combination of claim 18 wherein said ornament includes a pair of vertically spaced fasteners on a rear side thereof, each of which includes a head thereon.

20. The combination of claim 19 wherein each said spring tab includes a pair of ribs spaced apart to accept said head of a respective one of said pair of fasteners.

21. The combination of claim 1 further comprising an attachment clip for removably attaching said ornament to said shell and for removably attaching said ornament to said planter, said attachment clip comprising:

a front portion having a pair of vertically spaced right angle keyhole grooves therethrough, having a rearwardly projecting circular post, and having a rectangular rib adjacent said post, and a back portion having a pair of vertically spaced spring tabs each of which cooperates with one of said pair of vertically spaced right angle keyhole grooves, having a circular hole for receiving said circular post, and having a rectangular hole for receiving said rectangular rib.

22. The combination of claim 21 wherein said ornament includes a pair of vertically spaced fasteners on a rear side thereof, each of which includes a head thereon.

23. The combination of claim 22 wherein each said spring tab includes a pair of ribs spaced apart to accept said head of a respective one of said pair of fasteners.

24. The combination of claim 1 wherein said planter is also a cremation urn.

25. A memorialization accessory for memorializing a deceased comprising:

a planter adapted to receive a plant therein and having a first fastener element, an ornament including a second fastener element, said ornament attached to said planter with said first and second fastener elements, wherein one of said first and second fastener elements is at least one groove and the other of said first and second fastener elements is at least one fastener having a head thereon, and said ornament being previously attached to a casket in which the deceased was displayed for viewing, or being substantially identical to an ornament attached to the casket in which the deceased was displayed for viewing.

26. The memorialization accessory of claim 25 wherein said planter has four sides, a bottom, and an open top, and wherein one of said sides includes a recessed alcove structure in which to mount said ornament.

27. The memorialization accessory of claim 26 wherein said planter has a second alcove structure on a second side thereof for receiving cremation remains and a cover removably secured on said second alcove structure.

28. The memorialization accessory of claim 25 wherein said at least one groove comprises a slot and an opening communicating with said slot, said opening being of a greater dimension than said slot.

29. The memorialization accessory of claim 28 wherein said fastener is a threaded fastener.

30. The memorialization accessory of claim 29 wherein said threaded fastener is a screw.

31. The memorialization accessory of claim 30 wherein said screw is a shoulder screw.

32. The memorialization accessory of claim 25 wherein said first and second attachment elements are configured such that said ornament is removably secured to said planter via motion in first and second non-parallel directions generally parallel to a plane defined by a mounting surface of said planter.

33. The memorialization accessory of claim 32 wherein said at least one groove includes a first keyhole portion and a second non-keyhole portion.

34. The memorialization accessory of claim 33 wherein said first keyhole portion has a first longitudinal axis, said second non-keyhole portion has a second longitudinal axis, and said first and second longitudinal axes are non-parallel.

35. The memorialization accessory of claim 34 wherein said first and second longitudinal axes are perpendicular.

36. The memorialization accessory of claim 32 wherein said motion in said first and second directions is rectilinear.

37. The memorialization accessory of claim 25 wherein said first fastener element is an attachment clip comprising:

a front portion having a pair of vertically spaced right angle keyhole grooves therethrough, having a rearwardly projecting circular post, and having a rectangular rib adjacent said post, and a back portion having a pair of vertically spaced spring tabs each of which cooperates with one of said pair of vertically spaced right angle keyhole grooves, having a circular hole for receiving said circular post, and having a rectangular hole for receiving said rectangular rib.

38. The memorialization accessory of claim 37 wherein said second fastener element is a pair of vertically spaced fasteners on a rear side of said ornament, each of which includes a head thereon.

39. The memorialization accessory of claim 38 wherein each said spring tab includes a pair of ribs spaced apart to accept said head of a respective one of said pair of fasteners.

40. The memorialization accessory of claim 25 wherein said planter is also a cremation urn.

41. A method of memorializing a deceased comprising:

displaying the deceased for viewing in a casket to which is mounted an ornament, removing the ornament from the casket, mounting the ornament on a planter, and presenting the planter and ornament to a loved one of the deceased as a memorial to the deceased.

42. The method of claim 41 further comprising placing a plant in the planter prior to presenting the planter to the loved one.

43. A method of memorializing a deceased comprising:

displaying the deceased for viewing in a casket to which is mounted an ornament, removing the ornament from the casket, cremating the deceased, mounting the ornament on a combination planter and cremation urn, placing cremation remains of the deceased in the combination planter and cremation urn, and presenting the combination planter and cremation urn with cremation remains therein and ornament to a loved one of the deceased as a memorial to the deceased.

44. The method of claim 43 further comprising placing a plant in the combination planter and cremation urn prior to presenting the planter to the loved one.

45. A method of memorializing a deceased comprising:

displaying the deceased for viewing in a casket to which is mounted an ornament, cremating the deceased, providing a combination planter and cremation urn, mounting an ornament, which is substantially identical to the ornament mounted on the casket, to the combination planter and cremation urn, placing cremation remains of the deceased in the combination planter and cremation urn, and presenting the planter and ornament to a loved one of the deceased as a memorial to the deceased.

46. The method of claim 45 further comprising placing a plant in the planter prior to presenting the planter to the loved one.

* * * * *